US006582528B1

(12) United States Patent
Böhm et al.

(10) Patent No.: US 6,582,528 B1
(45) Date of Patent: Jun. 24, 2003

(54) METHOD OF PRODUCING NON-GRAIN-ORIENTED ELECTRICAL SHEET

(75) Inventors: Thomas Böhm, Herne (DE); Jürgen Schneider, Bochum (DE); Karl Telger, Coesfeld (DE); Carl-Dieter Wuppermann, Krefeld (DE); Rudolf Kawalla, Bobritzsch (DE); Karl Ernst Friedrich, Moers (DE)

(73) Assignee: ThyssenKrupp Electrical Steel EBG GmbH, Bochum (DE)

( * ) Notice: Subject to any disclaimer, the term of this patent is extended or adjusted under 35 U.S.C. 154(b) by 0 days.

(21) Appl. No.: 09/937,692

(22) PCT Filed: Apr. 19, 2000

(86) PCT No.: PCT/EP00/03558

§ 371 (c)(1),
(2), (4) Date: Dec. 28, 2001

(87) PCT Pub. No.: WO00/65103

PCT Pub. Date: Nov. 2, 2000

(30) Foreign Application Priority Data

Apr. 23, 1999 (DE) ..... 199 18 484

(51) Int. Cl.[7] ..... H01F 1/00
(52) U.S. Cl. ..... 148/120; 148/111

(58) Field of Search ..... 148/111, 120

(56) References Cited

U.S. PATENT DOCUMENTS

| | | | | |
|---|---|---|---|---|
| 3,819,426 A | | 6/1974 | Decaro et al. | |
| 4,046,602 A | * | 9/1977 | Stanley | 148/111 |
| 4,306,922 A | * | 12/1981 | Coombs et al. | 148/111 |
| 5,082,510 A | * | 1/1992 | Nishimoto et al. | 148/111 |
| 5,354,389 A | * | 10/1994 | Arai et al. | 148/111 |

FOREIGN PATENT DOCUMENTS

| | | | | |
|---|---|---|---|---|
| EP | 0 263 413 A2 | | 4/1988 | |
| EP | 0 434 641 A2 | | 6/1991 | |
| FR | 2 249 958 | | 5/1975 | |
| JP | 64000227 | | 1/1989 | |
| JP | 6-279859 | * | 10/1994 | 148/111 |

* cited by examiner

*Primary Examiner*—John Sheehan
(74) *Attorney, Agent, or Firm*—Proskauer Rose LLP

(57) ABSTRACT

Method for producing non-grain-oriented electric sheet comprising:

introducing steel input stock as a heated and prerolled slab into finishing rolls at a temperature of ≦1100° C. wherein the reheating temperature ($T_{BR}$) corresponds to a reheating target temperature ($T_{ZBR}$) determined by the formula:

$$T_{ZBR}(^\circ\text{ C.})=1195^\circ\text{ C.}+12.716*(G_{Si}+G_{Al})$$

wherein $T_{ZBR}$(° C.)=target temperature of the reheated slab $G_{Si}$=Si content in weight %

$G_{Al}$=Al content in weight % hot rolling to a thickness<3.5 mm at a final rolling temperature ($T_{ET}$)≧770° C.

coiling at a temperature ($T_{HT}$) wherein $$T_{HT}(^\circ\text{ C.})=154-1.8\alpha t+0.577\ T_{ET}+111d/d_0$$

wherein $d_0$=reference thickness of the strip=3 mm d=actual thickness of the strip in mm t=time in seconds between the end of hot rolling and coiling α=0.7/sec. to 1.3/sec. cooling factor pickling and cold rolling to a thickness of 0.2–1 mm.

12 Claims, 2 Drawing Sheets

METHOD OF PRODUCING NON-GRAIN-ORIENTED ELECTRICAL SHEET

BACKGROUND OF THE INVENTION

The invention relates to a procedure for manufacturing non-grain oriented electric sheet. In this connection, the term "non-grain oriented electric sheet" is understood as a steel sheet or steel strip that falls under the sheets mentioned in DIN EN 10106 regardless of its texture, whose loss anisotropy does not exceed that peak values set forth in European Standard DIN EN 10106. To this extent, the terms "electric sheet" and "electric strip" are here used synonymously.

In the following, "J2500" and "J5000" denote the magnetic polarization at a magnetic field strength of 2500 A/m and 5000 A/m. "P1.5" denotes the hysteresis loss at a polarization of 1.5 T and a frequency of 50 Hz.

The processing industry requires that non-grain oriented electric sheet be provided whose magnetic polarization values are increased relative to conventional sheets. This applies in particular to applications in which the induction of electric fields plays a special role. Increasing the magnetic polarization reduces the magnetization requirement. This is accompanied by a decrease in copper losses as well, which constitute a significant amount of the losses that arise during the operation of electrical equipment. Therefore, the economic value of non-grain oriented electric sheets with increased permeability is considerable.

The demand for higher-permeable non-grain oriented types of electric sheet relates not just to non-rain oriented electric sheets with high losses (P1.5≧5–6 W/kg), but also to sheets with average (3.5 W/kg≦P1.5≦5.5 W/kg) and low losses (P1.5≦3.5). Therefore, efforts are being made to improve the entire spectrum of slightly, moderately and highly silicated electrotechnical steels relative to their magnetic properties. In this case, the types of electric sheet with Si contents of up to 2.5 weight-% Si are especially important in terms of their market potential.

There are different known procedures for manufacturing highly permeable types of electric sheet, i.e., those with increased values of J2500 and J5000. For example, according to the procedure known from EP 0 431 502 A2, use is made of a non-grain oriented electric sheet by initially hot-rolling a steel input stock containing≦0.025% C, <0.1% Mn, 0.1 to 4.4% Si and 0.1 to 4.4% Al (figures in weight-%) to a thickness of at least 3.5 mm. The hot strip obtained in this way is subsequently cold-rolled without recrystallizing intermediate annealing at a deformation level of at least 86%, and subjected to annealing treatment.

The strip manufactured according to the known procedure exhibits a special cubic structure, a particularly high magnetic polarization of more than 1.7 T at a field strength J2500 of 2500 A/m and low hysteresis losses. However, this success is linked to the indicated special composition. This relates in particular to the Mn content, which was surprisingly found to be necessary to set the desired cubic texture. According to the known procedure, a specific ratio of Si and Al contents must also be maintained, which pivotally influences the properties of the respective electric sheet. Since these requirements are not satisfied for the entire range of products of interest here, the procedure described in EP 0 431 502 A2 only applies for the manufacture of sheets subject to particularly stringent requirements.

In addition to the procedures outlined above, technical literature also discloses other ways of improving the properties of electric sheets. For example, it has been proposed that the hot strip be subjected to intermediate annealing to produce highly permeable types of electric sheets (EP 0 469 980 B1, DE 40 05 807 C2).

Also known from EP 0434 641 A2 is a procedure for manufacturing a "semi-finished", non-grain oriented steel sheet. According to the known procedure, steel containing 0.002–0.01% C, 0.2–2.0% Si, 0.001–0.1% S, 0.001–0.006% N, 0.2–0.5% Al, 0.2–0.8% Mn is used to cast a slab. This slab is subjected to heat treatment at 1100° C. to 1200° C., and then to final hot-rolling, wherein the final rolling temperature lies between 830° C. and 950° C. Subsequently, the hot strip undergoes an annealing treatment, during which it is subjected to a temperature lying between 880° C. and 1030° C. for 30 to 120 seconds. The annealed hot strip is then cold-rolled without intermediate annealing, during which a reduction in thickness of 70%to 85%is achieved during the course of cold-rolling. Finally, the cold-rolled strip is subjected to recrystallization annealing at temperatures of 620° C. to 700° C. for 30 to 120 seconds.

Such a "semi-finished" electric sheet fabricated according to the procedure known form EP 0 434 641 A2 is delivered to the user before annealing, is there deformed and undergoes final annealing only after deformation. The advantage to proceeding in this way is that the quality lost relative to the magnetic properties during deformation can be offset by conducting final annealing only after the deformation. However, the annealing step to be performed at the user leads to a considerable outlay during the manufacture of structural components out of electric sheet delivered in the "semi-finished" state. In addition, the electric sheets manufactured according to EP 0 434 641 A2 exhibit magnetic properties that do not exceed the usual level, despite the use of a steel with a special composition, and despite the fact that the sheets are delivered in the "semi-finished" state, processed by the user and only annealed in the processed state.

All known procedures described above share in common that they each require basic materials with special compositions or are tied to process parameters and steps that must be strictly adhered to. As a result, the known procedures are not suited to offer a wide range of high-quality electric sheets based on a uniform manufacturing process and manufactured cost-effectively.

Finally known from EP 0 263 413 A2 is a procedure for manufacturing finish-annealed, non-grain oriented electric sheets in which the slabs used to fabricate the sheets are not preheated in excess of 1150° C., and a steel alloy precisely adjusted in terms of its Al and Si content is used. Hot strip annealing is not described in EP 0 263 413 A2, so that it can be presumed that the costs usually encountered for this operation do not arise in this known procedure. However, both the limitation of preheating temperature and provision of exact stipulations for setting the steel composition greatly limits the range of electric sheet goods that can be subsequently manufactured according to EP 0 263 413 A2.

Proceeding from the prior art as summarized above, the object of the invention is to indicate a procedure with which a wide range of high-quality, non-grain oriented electric sheets with improved magnetic properties can be manufactured.

SUMMARY OF THE INVENTION

This object is achieved according to the invention by a procedure in which steel input stock, containing (in weight-%)≦0.06% C, 0.03–2.5% Si, ≦0.4% Al, 0.05–1.0% Mn, ≦0.02% S and, if desired, other alloying additives P, Sn, Sb, Zr, V, Ti, N and/or B with a content of up to 1.5 weight-% at most, with iron and other conventional companion elements as the residue, as a slab heated to a reheating temperature ($T_{BR}$) which, with a maximal deviation of ±20° C., corresponds to a reheating target temperature ($T_{ZBR}$)

$$T_{ZBR}[^\circ\text{ C.}]=1195^\circ\text{ C.}+12{,}716*(G_{Si}+2G_{Al})$$

wherein $T_{ZBR}$: Target temperature of reheated slab $G_{Si}$: Si content in weight-%

$G_{Al}$: Al content in weight-% and pre-rolled, or as a directly used cast strip or thin slab, is introduced into a group of finishing roll stands at an entry temperature of ≦1100° C., and hot-rolled into a hot strip with a thickness of <3.5 mm at a final rolling temperature ($T_{ET}$)≧770° C., in which the hot strip is reeled up at a coiling temperature ($T_{HT}$) determined as follows with a maximal deviation of ±10° C.:

$$T_{HT}[^\circ\text{ C.}]=154-1.8\alpha t+0.577T_{ET}+111d/d_0$$

wherein $d_0$: Reference thickness of the hot strip=3 mm d: Actual thickness of the hot strip in mm t : Time between the end of hot rolling and reeling in s α: Cooling factor 0.7 $s^{-1}$–1.3 $s^{-1}$ wherein the hot strip is subsequently pickled without preceding hot-strip annealing, and, after pickling, cold-rolled in several passes into a cold strip with a thickness of 0.2–1 mm at an overall maximal deformation level of 85%, and wherein the cold strip is subjected to a final treatment.

Cooling based on the rolling end temperature can here take place in air or with the assistance of water. The reference thickness $d_0$ is understood as the thickness of a specimen on which the respective cooling factor was determined.

Subjecting the slabs to heat treatment adjusted to the respective Si and Al content prior to hot rolling improves the precipitation structure, which yields improved magnetic properties for the sheet fabricated according to the invention.

It makes sense to pre-roll the slab before finish hot-rolling in several passes to a thickness of 20–65 mm. In this way, the deformation levels to be achieved during subsequent finish-rolling to a strip thickness of <3.5 mm are low, thus facilitating the development of outstanding magnetic properties for the electric sheet. In this conjunction, it is also best for the reduction per pass not to exceed 25% while pre-rolling the slab. This also facilitates the manufacture of an electric sheet with particularly good magnetic properties. Another improvement can be achieved by having pre-rolling take place in at least four passes. This step additionally promotes the establishment of a favorable structure in terms of the desired high magnetic polarization.

The results achievable when proceeding according to the invention can be further improved by having the final rolling temperature during hot rolling with a maximal deviation of ±20° C. not dip below a final rolling target temperature ($T_{ZET}$) determined as follows:

$$T_{ZET}[^\circ\text{ C.}]=790^\circ\text{ C.}+40*(G_{Si}+2G_{Al})$$

wherein $T_{ZET}$: Final rolling target temperature $G_{Si}$: Si content in weight-%

$G_{Al}$: Al content in weight-%

In addition, it is advantageous with regard to the establishment of a structure favorable in terms of the magnetic structure if finish-rolling during hot rolling takes place in several passes, and the deformation levels decrease from 50% to 5% as the number of passes increase.

The invention makes it possible to manufacture electric sheets with improved magnetic properties by specifically adjusting the individual procedural steps, in particular by adjusting the preheating temperature as a function of the Si and Al content of the steel and adjusting the coiling temperature as a function of the respective cooling behavior and final rolling temperature, without hot-strip annealing being necessary. When proceeding according to the invention, steel materials with a conventional composition can hence be used to manufacture electric sheets in a single procedural step that satisfy the increased requirements placed on their magnetic properties.

As mentioned, one essential aspect of the invention has to do with the selection of the coiling temperature, which must be set based on the condition provide for this purpose according to the invention. If the coiling temperature determined in this way is observed, the structure in the material is homogenized, adjusted to the respective final rolling temperature. This improves the properties of electric sheets manufactured according to the invention relative to the hysteresis losses and magnetic polarization. In this conjunction, the rule indicated above for measuring the final rolling target temperature range is also of particular importance. If the final rolling temperatures are selected in such a way as to fall within the range described by this rule, the coiling temperature and final rolling temperature are adjusted to each other in an optimized manner. This optimized adjustment results in a hot strip that can be used to better impart an advantageous magnetic texture in the ensuing steps.

Electric sheets manufactured according to the invention exhibit improved magnetic properties relative to electric sheets fabricated based on the same alloys, but following a conventional procedure. In each case, the magnetic polarization is significantly increased. Additional procedural steps or changes in the alloy compositions are not required for this purpose. Even low-silicated types generated according to the invention have magnetic properties that can only be achieved in conventional procedures through the use of cost-increasing hot-band annealing.

The final annealing required to manufacture finish-annealed "fully-finished" electric sheet is preferably executed in a continuous furnace according to the invention. Final annealing here best takes place at a final annealing temperature of ≧780° C. This temperature should measure at most 1,100° C., wherein the final annealing temperature can be determined in the following manner as a function of the sum of Si and Al contents:

$$y=G_{Si}+G_{Al}$$

$$y\leqq 1.2{:}\,T_A[^\circ\text{ C.}]\geqq 780$$

$$y>1.2{:}\,T_A[^\circ\text{ C.}]\geqq 780+120(y-1.2)$$

wherein $T_A$: Final annealing temperature $G_{Si}$: Si content in weight-%

$G_{Al}$: Al content in weight-%

It is also beneficial for the retention time to measure ≦30 seconds at the maximal final annealing temperature.

In the following, the invention will be described in greater detail based on embodiments.

BRIEF DESCRIPTION OF THE DRAWING

The sole FIGURE depicts a flowchart showing the steps that are followed during the manufacture of electric sheets according to the invention.

DETAILED DESCRIPTION OF THE INVENTION

Figure 1:
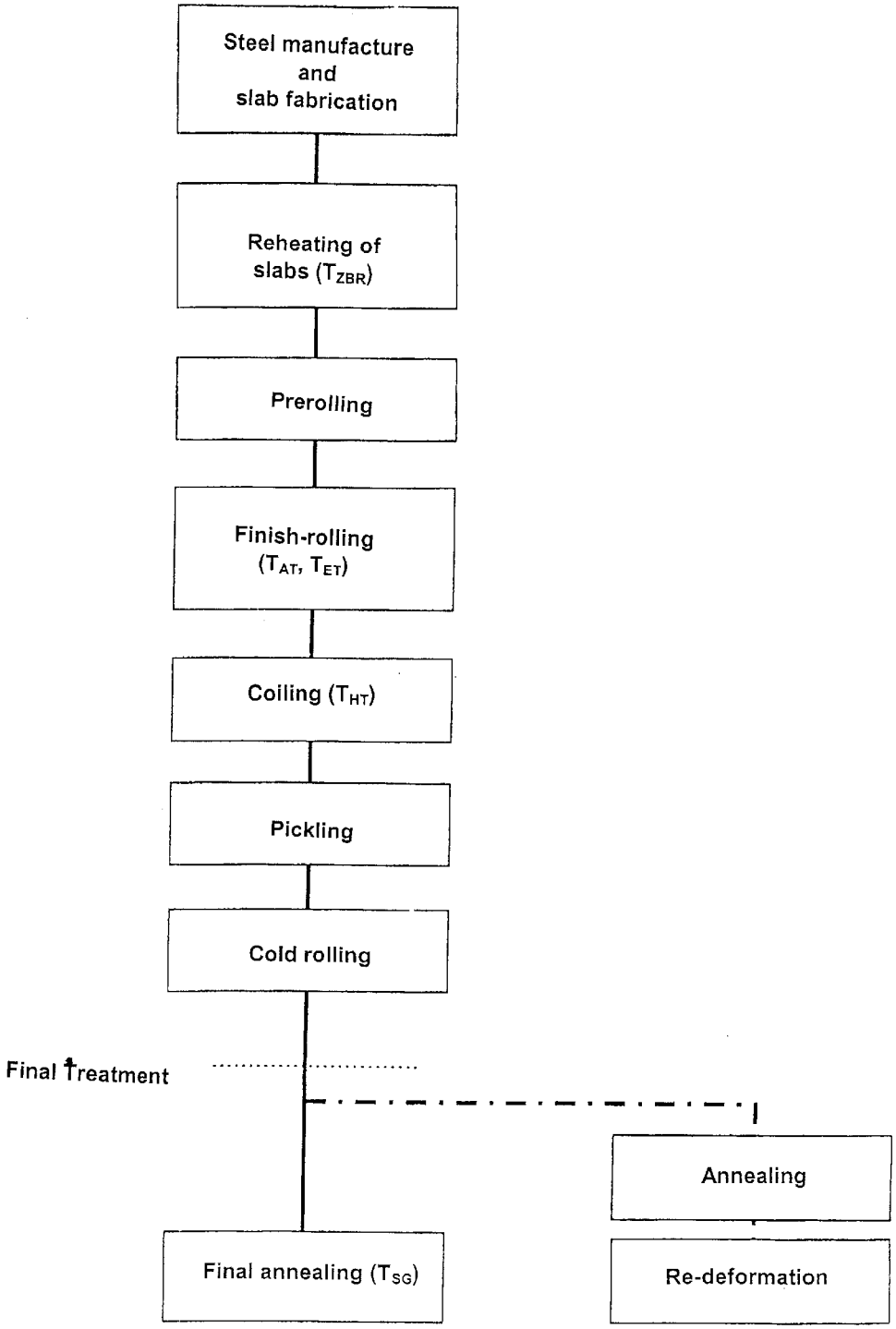
Figure 2:
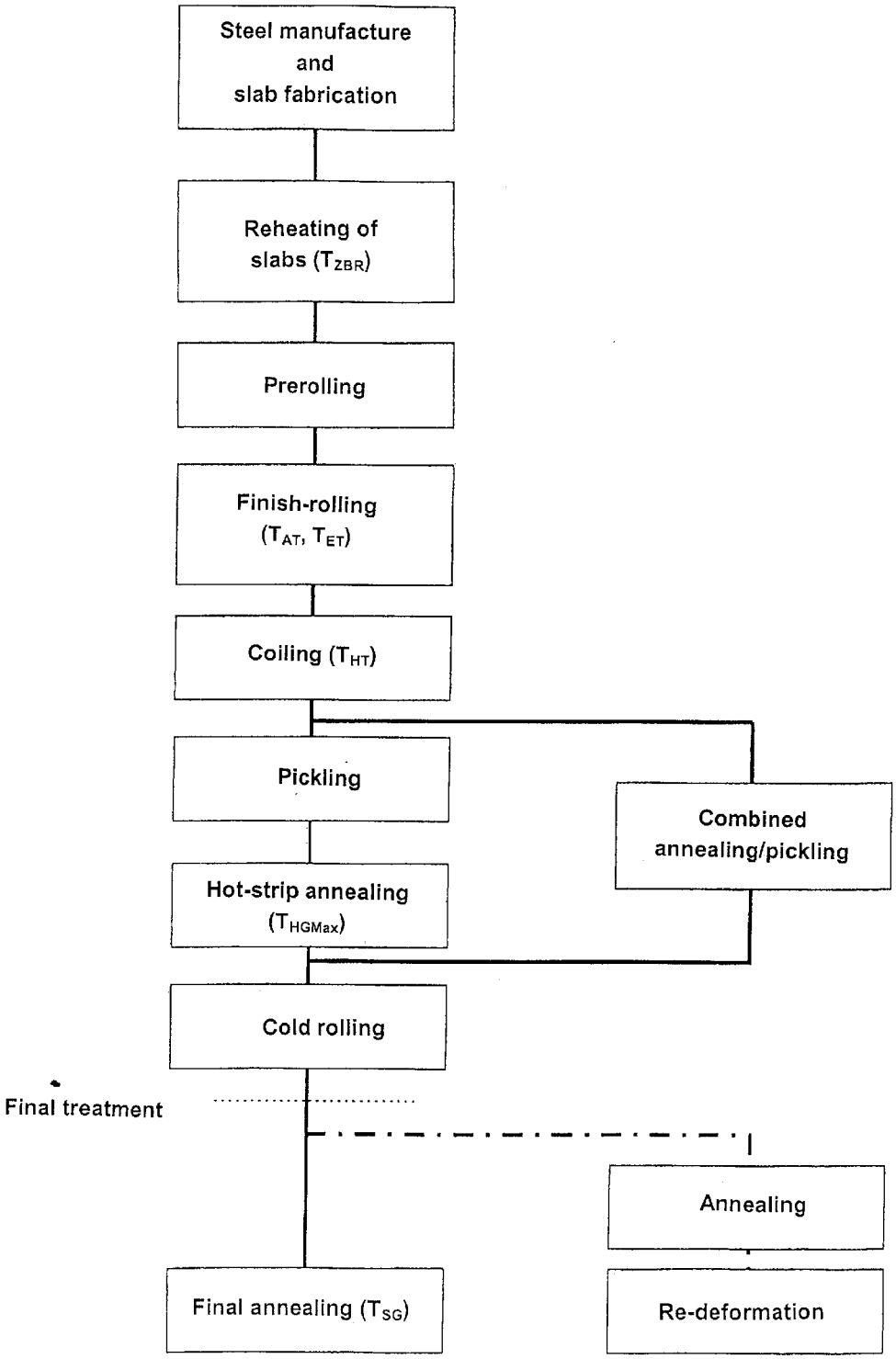

During the manufacture of electric sheets according to the invention, slabs are first fabricated from steel with a specific composition. The respective compositions are indicated on Tables 1 and 2 for examples of electric sheets 1 to 8.

The slabs are subsequently reheated to a reheating temperature $T_{ZBR}$ of up to 1250° C. In this case, the reheating temperature with a maximal deviation of ±20° C. is determined individually as a function of Si and Al content $G_{Si}$, $G_{Al}$ of the respective alloy according to the equation $$T_{ZBR}[^\circ\ C.]=1195^\circ\ C.+12.716*(G_{Si}+2G_{Al})$$

The slab reheated in this way is pre-rolled to a thickness of 20–65 mm in several passes, in which the reduction per pass does not exceed 25%, and introduced into a group of finishing roll stands at an entry temperature $T_{AT}$ of at most 1100° C. There, it is hot-rolled into a hot strip with a thickness of <3.5 mm, wherein deformation levels decrease from 50% to 5% as the number of passes increase.

The finish-rolled hot strip is then coiled. The temperature $T_{HT}$ at which respective strips were coiled after hot rolling is calculated given a permissible deviation of at most 10° C. according to the equation $$T_{HT}[^\circ\ C.]=154-1.8at+0.577T_{ET}+111d/d_0.$$

The reference thickness do of the hot strip measured 3 mm in the examples, while the actually present thickness d of the hot-rolled strip varied between 2.75 and 3.1 mm. The cooling factor a ranged from 0.7 $s^{-1}$ to 1.3 $s^{-1}$. The time t between the end of hot rolling and reeling measured between 10 and 25 or 8 and 30 seconds. The final rolling temperature $T_{ET}$ at the end of the group of finishing roll stands and the respective specifically achieved coiling temperature $T_{HT}$ is also indicated on Tables 1 and 2 for the individual examples.

After coiling, the hot strip passes through a pickle bath without first being subjected to hot strip annealing, and, after pickling, is cold-rolled in several passes into a cold strip with a thickness of 0.2–1 mm at an overall deformation level of at most 85%.

Finally, the electric sheets are finish-annealed in a continuous furnace. The maximal temperature $T_{SG}$ achieved here is also indicated on Tables 1 and 2.

In addition, Tables 1 and 2 list the magnetic properties for each individual example.

TABLE 1

| | Examples | | | | | |
|---|---|---|---|---|---|---|
| Group A | 1 | 2 | 3 | 4 | 5 | 6 |
| Composition (weight - %) | | | | | | |
| Si | 0.6 | 0.6 | 1.3 | 1.3 | 1.8 | 1.8 |
| Al | =0.01 | =0.01 | 0.15 | 0.15 | 0.35 | 0.35 |
| Mn | 0.4 | 0.4 | 0.2 | 0.2 | 0.25 | 0.25 |
| S, P and other alloying additives | as in Cl.1 | as in Cl.1 | as in Cl.1 | as in Cl.1 | as in Cl.1 | as in Cl.1 |
| Fe | Residual | Residual | Residual | Residual | Residual | Residual |
| Process temperatures (° C.) | | | | | | |
| ET | 850 | 850 | 890 | 880 | 900 | 910 |
| $T_{HT}$ | 725 | 725 | 750 | 750 | 740 | 750 |
| $T_{SG}$ | 870 | 920 | 920 | 920[1)] | 960[2)] | 980[2)] |
| Magnetic properties | | | | | | |
| Polarization in T | | | | | | |
| at 2500 A/m | 1.684 | 1.67 | 1.654 | 1.657 | 1.612 | 1.612 |
| Sample A | 1.669 | 1.666 | 1.645 | 1.649 | 1.62 | 1.616 |
| Sample B | 1.675 | | 1.658 | 1.643 | 1.611 | 1.617 |
| Sample C | 1.668 | | 1.657 | | | |
| Sample D | | | 1.648 | | | |
| Sample E | | | 1.643 | | | |
| Sample F | | | 1.648 | | | |
| Sample G | | | | | | |
| Polarization in T | | | | | | |
| at 5000 A/m | 1.77 | 1.751 | 1.73 | 1.74 | 1.69 | 1.689 |
| Sample A | 1.751 | 1.748 | 1.721 | 1.733 | 1.696 | 1.699 |
| Sample B | 1.756 | | 1.739 | 1.721 | 1.694 | 1.7 |
| Sample C | 1.75 | | 1.74 | | | |
| Sample D | | | 1.725 | | | |
| Sample E | | | 1.72 | | | |
| Sample F | | | 1.725 | | | |
| Sample G | | | | | | |
| P1.0, hysteresis loss | | | | | | |
| at 50 Hz in | 3.08 | 2.97 | 2.35 | 2.58 | 2.03 | 1.75 |
| W/kg | 2.95 | 3.15 | 2.36 | 2.58 | 2.03 | 1.81 |
| Sample A | 2.87 | | 2.36 | 2.58 | 2.06 | 1.83 |
| Sample B | 2.99 | | 2.39 | | | |
| Sample C | | | 2.34 | | | |
| Sample D | | | 2.37 | | | |
| Sample E | | | 2.35 | | | |
| Sample F | | | | | | |
| Sample G | | | | | | |

TABLE 1-continued

| Group A | Examples 1 | 2 | 3 | 4 | 5 | 6 |
|---|---|---|---|---|---|---|
| P1.5, hysteresis loss | | | | | | |
| at 50 Hz in | 6.63 | 6.44 | 5.02 | 5.53 | 4.41 | 3.9 |
| W/kg | 6.38 | 6.79 | 5.01 | 5.54 | 4.44 | 3.95 |
| Sample A | 6.16 | | 5.1 | 5.52 | 4.47 | 3.94 |
| Sample B | 6.46 | | 5.07 | | | |
| Sample C | | | 5.03 | | | |
| Sample D | | | 5.1 | | | |
| Sample E | | | 5.06 | | | |
| Sample F | | | | | | |
| Sample G | | | | | | |

[1]Annealing took place in a moist atmosphere.
[2]Annealing took place in a dry atmosphere.

TABLE 2

| Examples Group B | 7 | 8 |
|---|---|---|
| Composition (weight-%) | | |
| Si | 0.15 | 0.6 |
| Al | 0.1 | = 0.01 |
| Mn | 0.4 | 0.4 |
| S, P and other alloying additives | as in Cl. 9 | as in Cl. 9 |
| Fe | Residual | Residual |
| Process temperatures (° C.) | | |
| ET | 850 | 830 |
| $T_{HT}$ | 730 | 710 |
| $T_{SG}$ | 850 | 870 |
| Magnetic properties | | |
| Polarization in T at 2500 A/m | | |
| Sample A: | 1,686 | 1,672 |
| Sample B: | 1,681 | 1,676 |
| Polarization in T at 5000 A/m | | |
| Sample A: | 1,772 | 1,748 |
| Sample B: | 1,767 | 1,757 |
| P1.0, hysteresis loss at 50 Hz in W/kg | 3,14 | 2,83 |
| Sample A: | 3,12 | 2,81 |
| Sample B: | | |
| P1.5, hysteresis loss at 50 Hz in W/kg | 6,78 | 6,07 |
| Sample A: | 6,79 | 6,12 |
| Sample B: | | |

What is claimed is:

1. A method for manufacturing a non-grain oriented electric sheet comprising:

introducing steel input stock as a heated and prerolled slab into a group of finishing roll stands at an entry temperature of ≦1100° C., wherein a reheating temperature ($T_{BR}$) with a maximal deviation of ±20° C. corresponds to a reheating target temperature ($T_{ZBR}$) determined as follows:

$$T_{ZBR}[^\circ\text{ C.}]=1195^\circ\text{ C.}+12.716*(G_{Si}+2G_{Al})$$

wherein $T_{ZBR}$: Target temperature of reheated slab $G_{Si}$: Si content in weight-%

$G_{Al}$: Al content in weight-%, and wherein the steel input stock contains (in weight-%)

C: ≦0.06%

Si: 0.03–2.5%

Al: ≦0.4%

Mn: 0.05–1.0%

S: ≦0.02% balance iron and residual impurities;

hot-rolling the slab into a hot strip with a thickness of <3.5 mm at a final rolling temperature ($T_{ET}$)≧770° C., wherein $T_{ET}$ corresponds to a temperature of the steel input stock exiting the finishing roll stands; and coiling up the hot strip at a coiling temperature ($T_{HT}$) determined as follows with a maximal deviation of ±10° C.:

$$T_{HT}[^\circ\text{ C.}]=154-1.8\alpha t+0.577T_{ET}+111d/d_0$$

wherein $d_0$: Reference thickness of the hot strip=3 mm d: Actual thickness of the hot strip in mm t: Time in seconds between the end of the hot rolling and coiling α: 0.7 per second to 1.3 per second cooling factor, wherein the hot strip is subsequently pickled without being first annealed, and, after pickling, cold-rolled into a cold strip with a thickness of 0.2–1 mm at an overall maximal deformation level of 85%, and wherein the cold strip is subjected to a final treatment.

2. The method of claim 1, wherein the steel input stock contains at least one alloying additive selected from the group consisting of P, Sn, Sb, Zr, V, Ti, N and B, wherein the total content is up to 1.5 weight-%.

3. The method of claim 1, wherein the steel input stock is introduced directly into the finishing rolls stand as a cast strip or a thin slab.

4. The method of claim 1, wherein the steel input stock is a slab prerolled in several passes to a thickness of 20–65 mm prior to finish-rolling.

5. The method of claim 4, wherein while pre-rolling the slab each reduction per pass does not exceed 25%.

6. The method of claim 4, wherein prerolling takes place in at least four passes.

7. The method of 1, wherein the final rolling temperature ($T_{ET}$) with a maximum deviation of ±20° C. during hot rolling corresponds to a final rolling target temperature ($T_{ZET}$) determined as follows:

$$T_{ZET}[^\circ\text{ C.}]=790^\circ\text{ C.}+40*(G_{Si}+2G_{Al})$$

wherein $T_{ZET}$: Final rolling target temperature $G_{Si}$: Si content in weight-%

$G_{Al}$: Al content in weight-%.

8. The method of claim 1, wherein the finish rolling takes place in several passes during hot rolling, and wherein the deformation levels decrease from 50% to 5% as the number of passes increases.

9. The method of claim 1, wherein in a continuous furnace final annealing takes place at a final annealing temperature ($T_A$)≧780° C.

10. The method of claim 9, wherein the final annealing temperature ($T_A$) measures at most 1100° C.

11. The method of claim 9, wherein the final annealing temperature ($T_A$) is determined as a function of the sum of Si and Al contents as follows:

$$Y=S_{Si}+G_{Al}$$

$$Y\leqq 1.2:T_A[^\circ\text{ C.}]\geqq 780$$

$$Y>1.2:T_A[^\circ\text{ C.}]\geqq 780+120(Y-1.2)$$

where $T_A$: Final annealing temperature $S_{Si}$: Si content in weight-%

$G_{Al}$: Al content in weight-%.

12. The method of claim 9, wherein a retention time at maximal annealing temperature ($T_A$) measures≦30 seconds.

* * * * *